US005297403A

United States Patent [19]

Farrington et al.

[11] Patent Number: 5,297,403

[45] Date of Patent: Mar. 29, 1994

[54] ROTATABLE WASH BASKET FOR AN AUTOMATIC WASHER

[75] Inventors: Eric K. Farrington, Lincoln Township, Berrien County; Brenner M. Sharp, St. Joseph Township, Berrien County, both of Mich.

[73] Assignee: Whirlpool Corporation, Benton Harbor, Mich.

[21] Appl. No.: 985,046

[22] Filed: Dec. 3, 1992

[51] Int. Cl.[5] ..... D06F 37/12

[52] U.S. Cl. ..... 68/23.3; 68/133; 68/174

[58] Field of Search ..... 68/133, 174, 23.3, 23.7, 68/3 R

[56] References Cited

U.S. PATENT DOCUMENTS

| | | | |
|---|---|---|---|
| 2,921,460 | 1/1960 | Aberle | 68/131 |
| 3,087,776 | 4/1963 | Anderson | 68/174 |
| 3,145,551 | 8/1964 | Ziegler | 68/23.7 X |
| 3,481,161 | 12/1969 | Waseman | 68/133 X |
| 3,535,897 | 10/1970 | Douglas | 68/23.3 |
| 3,548,617 | 12/1970 | Wasemann | 68/133 |
| 3,589,151 | 6/1971 | Gorsuch | 68/23.7 |
| 3,603,118 | 9/1971 | Brucken et al. | 68/174 |
| 3,772,925 | 11/1973 | Sisson | 68/23.7 |
| 4,202,187 | 5/1980 | Hukuzawa et al. | 68/18 F |
| 4,216,663 | 8/1980 | Shacklock | 68/3 R |
| 4,444,027 | 4/1984 | Ikeda | 68/23.6 |
| 4,483,161 | 11/1984 | Oida | 68/23.6 |
| 4,646,545 | 3/1987 | Fanson et al. | 68/23.2 |
| 4,803,855 | 2/1989 | Kennedy | 68/23.7 |
| 5,012,658 | 5/1991 | Shikamori et al. | 68/12.01 |

*Primary Examiner*—Frankie L. Stinson

*Attorney, Agent, or Firm*—Stephen D. Krefman; Thomas J. Roth; Thomas E. Turcotte

[57] ABSTRACT

An automatic washing machine having a imperforate stationery tub and further having a rotatable plastic wash basket, for receiving a clothes load, disposed within the tub. The rotatable plastic wash basket includes a cylindrical outer wall defining a vertical axis and having an upper end open for receiving the clothes load. A base integral with the cylindrical outerwall is provided for forming a bottom of the rotatable basket. A hub member is positioned centrally in the base and is drivingly connectable with a drive shaft for rotating said rotatable wash basket. The base further includes an annular cavity, formed within the base, surrounding the hub member. The annular cavity has a substantially triangular radial cross-section such that the base comprises walls which define the annular cavity and form a triangular truss optimally configured for providing strength and rigidity to the wash basket base.

16 Claims, 3 Drawing Sheets

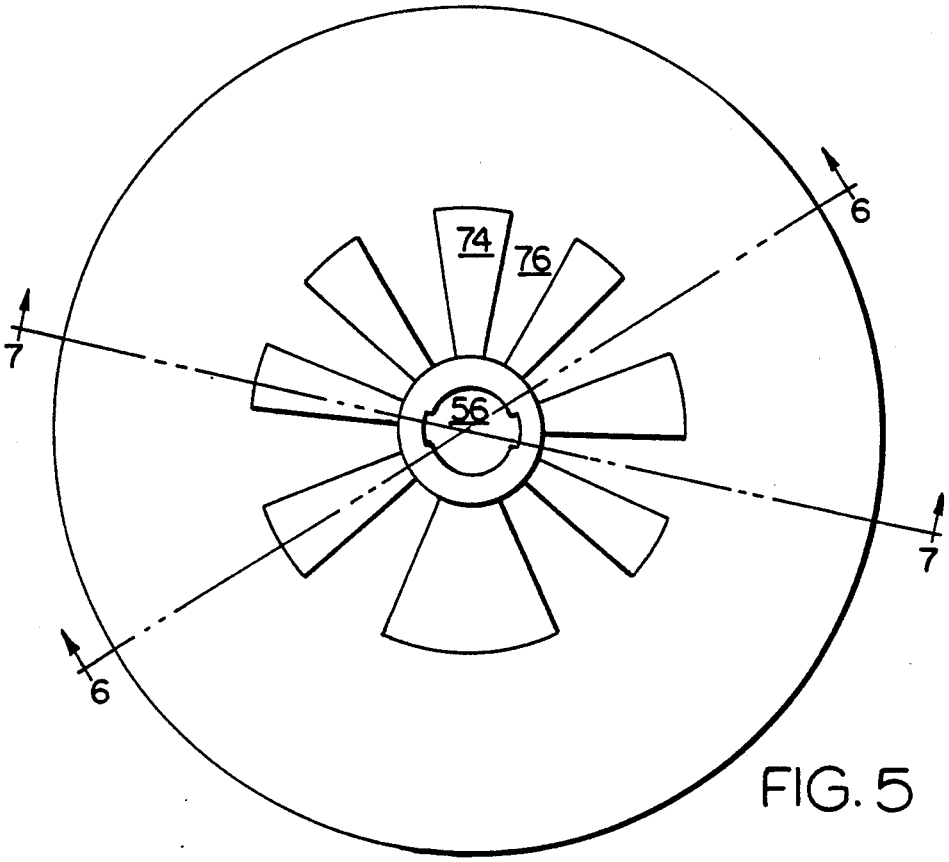
FIG. 5
FIG. 6
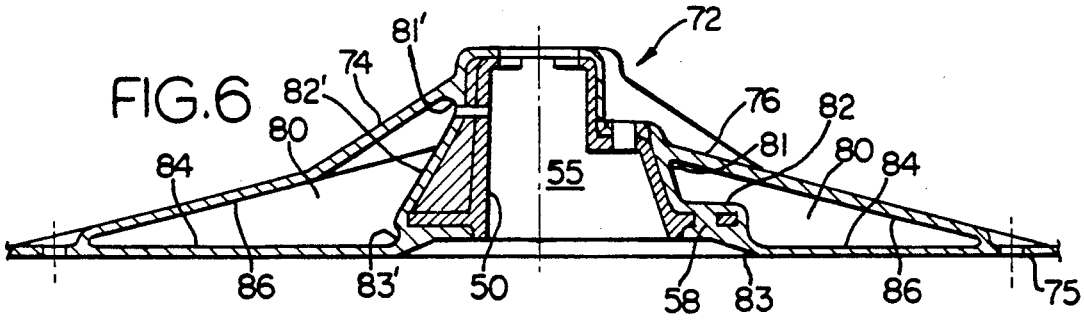
FIG. 7
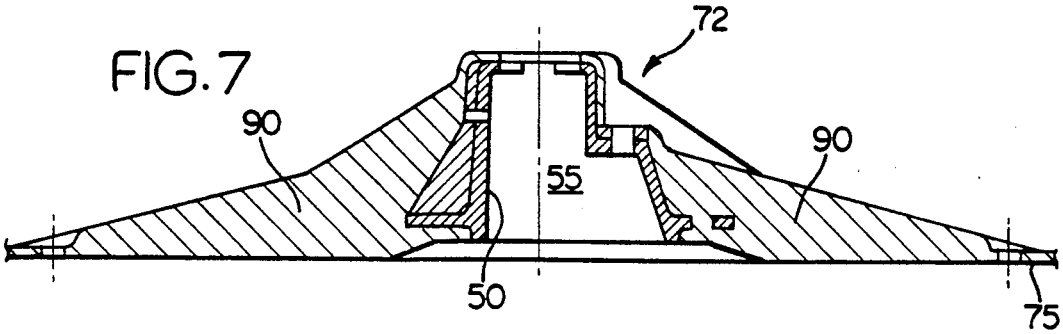

ROTATABLE WASH BASKET FOR AN AUTOMATIC WASHER

BACKGROUND OF THE INVENTION

1. Field of the Invention

The present invention relates to a washing machine and more particularly to a rotatable plastic wash basket having sufficient rigidity to prevent undue vibration and deflection.

2. Description of the Prior Art.

Rotatable wash baskets for use in automatic washers may be subject to various types of forces during basket spin and may have particular dynamic responses to forced vibrations which may occur during basket spin The types of forces experienced by the basket typically include a centrifugal force created by an evenly distributed load of clothes, a localized imbalance force created by an unevenly distributed load of clothes and a reactive force applied at the top lip of the basket by spinning water in a balance ring. The wash basket is typically supported by a hub member which is interconnected with a drive shaft for supporting and rotating the wash basket The localized imbalance force resulting from an unevenly distributed load of clothes creates a moment at the hub member, and if uncorrected, may create undesired vibration in the wash basket during rotation. Preferably, the reactive force resulting from the spinning water in the balance ring will create a substantially equal and opposite moment at the hub member for correction of the localized imbalance such that undesired vibration is prevented. An eccentric spin condition must exist for the balance ring to function therefore some small difference typically exists between the moment created by the reactive force at the hub member and and the moment created by the localized imbalance force at the hub member. However, due to physical size limitations in the balance ring, in the case of large localized imbalance forces large differences in moments may exist These differences result in an overall imbalanced condition for the wash basket which subjects the rotating wash basket to forced vibrations during spin. These forced vibrations will have a frequency equal to the spin frequency (basket revolutions/sec) of the rotatable wash basket.

Typically, rotatable wash baskets for use in an automatic washer are constructed of metal. For example, U.S. Pat. No. 4,890,465 shows a metallic rotatable wash basket having a single wall basket structure including a single wall base structure. U.S. Pat. No. 2,921,460 shows a metallic rotatable wash basket having a single wall basket structure including a single wall base structure having an additional rigid metallic bottom plate attached to the base for providing base rigidity. Because of the inherent stiffness and strength of metal, rotatable wash baskets made of metal are sufficient to withstand the various forces to which a rotatable wash basket may be subjected.

It is also well known to utilize plastic rotatable wash baskets in an automatic washer. The use of a plastic material for a rotatable wash basket may offer various advantages over metal including lower cost and corrosion resistance. However, the strength of plastic is such that simple single wall wash basket construction, similar to metallic wash basket designs, may not have adequate strength and stiffness. Plastic processing limitations prevent wash basket designers from simply increasing the thickness of the plastic walls to improve wash basket strength Therefore, to provide adequate strength and stiffness in a plastic basket, various wash basket reinforcement configurations are employed. These wash basket reinforcement configurations are typically intended to provide additional strength to the bottom or base of the wash basket. In particular, the prior art shows the use of reinforcing ribs located on the base of a plastic rotatable wash basket or the use of a rigid metallic bottom plate attached to the base of a plastic rotatable wash basket.

For example, U.S. Pat. No. 5,012,658 illustrates the use of reinforcing ribs located on the base of a rotatable plastic wash basket for providing the necessary strength and stiffness. The use of reinforcing ribs, however, may have several disadvantages. The use of external ribs on the base of a wash basket may cause the formation of an undue amount of suds between the rotatable basket and an imperforate, non-rotatable tub. This suds condition may cause the automatic washer to fail to adequately perform various functions. Furthermore, ribbed base designs may still not offer equivalent strength and stiffness as compared to metallic wash baskets having metallic base structures and rotatable plastic basket having a ribbed base may be inadequate to withstand the various forces to which a rotating wash basket is subjected.

Additionally, U.S. Pat. No. 4,483,161 and U.S. Pat. No. 4,444,027 illustrate the use of a metal reinforcing plate secured to the base of a plastic rotating wash basket for providing the required stiffness and strength. The use of a metallic reinforcing plate may also have several disadvantages. The use of a reinforcing plate requires the use of fasteners which increases the difficulty of assembly. In addition, a metallic reinforcing plate may create corrosion problems. Finally, the addition of a reinforcing plate and fasteners may increase the cost of the rotatable wash basket.

In both plastic and metallic rotatable wash baskets, the deflection and the dynamic response of the rotatable wash basket may be influenced by several factors including the overall stiffness of the wash basket. In particular, the basket should preferably be designed such that the lowest natural frequency of the wash basket structure is greater than the spin frequency of the rotatable wash basket so that undue vibration may be avoided. Given the inherent stiffness and strength of metal, undue deflection or vibration has typically not been an issue in the design of metallic baskets. Typically, the lowest natural frequency of a metallic basket is higher than the spin frequency of the basket and therefore excitation of the basket at its natural frequency is avoided. However, since plastic has less inherent strength and stiffness than metal, plastic baskets typically require reinforced structure to prevent undue deflection and vibration.

Engineering analysis performed by the inventors has shown that the base which forms the bottom wall of the basket is critical in dictating the stiffness of the entire basket. Therefore, a plastic rotatable wash basket having a base geometry which provides adequate stiffness to the entire basket may provide a basket design having its lowest natural frequency higher than the spin frequency of the basket such that undue vibrations are not experienced during basket spin. Prior art, however, appears to teach the use of relatively thick walls in the vertical cylindrical portion of the plastic wash basket for achieving stiffness and strength. This manner of providing basket stiffness for preventing undue deflection and vibration is relatively ineffective and expensive. Therefore, a basket having a base geometry which provides adequate stiffness may have a cylindrical outerwall portion of the basket having a wall thickness less than a wash basket having a base with inadequate stiffness such that a basket having an adequately stiff base may use less material than a basket having an inadequately stiff base.

There is, therefore, a need for a plastic rotatable wash basket for use in an automatic washer having a structure sufficient to withstand the forces applied to the basket, but which does not create a sudsing problem or require additional reinforcing plates. Additionally, there is a need for a plastic rotatable wash basket having a base sufficiently stiff such that the lowest natural frequency of the rotatable basket is greater than the spin frequency of the rotatable wash basket. Furthermore, there is a need for a plastic basket construction which minimizes the basket wall thickness thereby being of relatively low cost.

SUMMARY OF INVENTION

Accordingly, an object of the invention is to provide an automatic washer having a rotatable plastic wash basket having a base structure sufficient to accommodate the various forces applied to the basket. Another object is to provide a rotatable plastic wash basket having a lowest natural frequency greater than the spin frequency of the basket. A further object is to provide a rotatable plastic wash basket having a base structure which does not cause the formation of an undue amount of suds between the rotatable wash basket and an imperforate stationary wash tub. A still further object of the invention is to provide a rotatable plastic wash basket meeting the above described objectives and being of relatively low cost, being relatively easy to assemble and not requiring any additional metal reinforcing plates.

To achieve these objects, according to the invention, there is provided an automatic washing machine having a imperforate stationery tub and further having a rotatable plastic wash basket, for receiving a clothes load, disposed within the tub. The rotatable plastic wash basket further comprises a cylindrical outer wall defining a vertical axis and having an upper end open for receiving the clothes load. A base integral with the cylindrical outerwall is provided for forming a bottom of the rotatable basket. A hub member is positioned centrally in the base and is drivingly connectable with a drive shaft for rotating said rotatable wash basket. The base further includes an annular cavity, formed within the base, surrounding the hub member. The annular cavity has a substantially triangular radial cross-section such that the base comprises walls which define the annular cavity and form a triangular truss optimally configured for providing strength and rigidity to the wash basket base.

Other objects of the invention may become clear to those skilled in the Art, from the following description of the preferred embodiments when taken in conjunction with the following drawings.

BRIEF DESCRIPTION OF THE DRAWINGS

FIG. 5 is a top elevational view of the base of wash basket of FIG. 1 and FIG. 2

FIG. 6 is an enlarged sectional view taken along lines 6—6 of the base of the wash basket of FIG. 5.

FIG. 7 is an enlarged sectional view taken along lines 7—7 of the base of the wash basket of FIG. 5.

DESCRIPTION OF THE PREFERRED EMBODIMENTS

Figure 1:
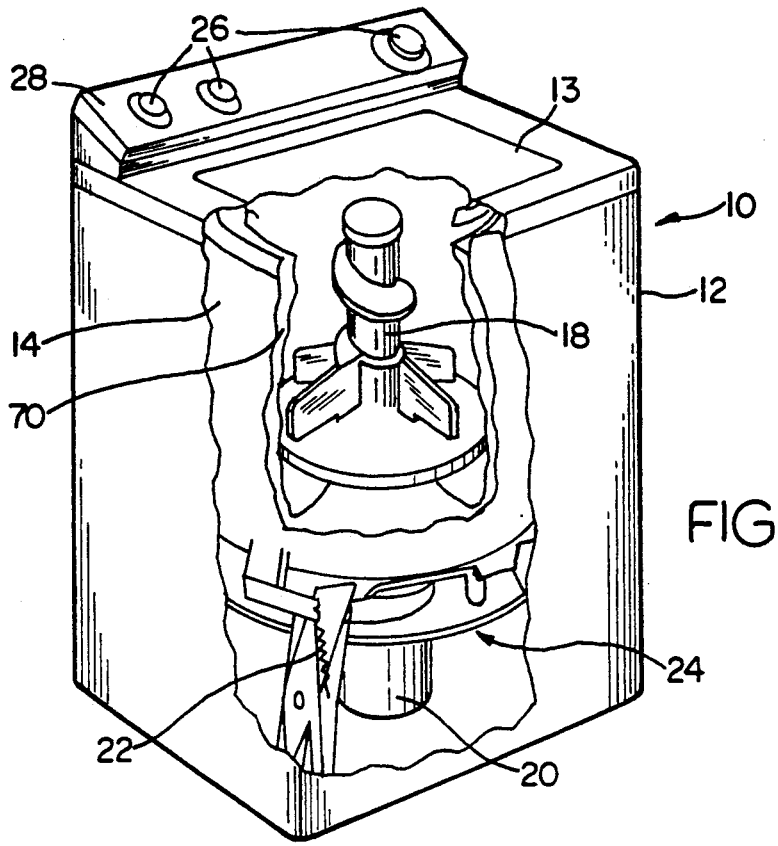
FIG. 1 is a perspective view of an automatic washer embodying the principles of the present invention

In FIG. 1 there is illustrated an automatic washer 10 embodying the principles of the present invention. The washer 10 has an outer cabinet 12 with an openable lid 13 which encloses an imperforate wash tub 14 for receiving a supply of wash liquid. Concentrically mounted within the wash tub 14 is a plastic wash basket 70, further described hereinbelow, for receiving a load of materials to be washed, and further mounted within the wash basket 70 is a vertical axis agitator 18. A motor 20 is provided which is drivingly connected through a drive system 24 to the vertical axis agitator 18 to drive it in an oscillatory or rotary manner and is also selectively connectible to the plastic wash basket 70 to drive it in a rotary manner. The assembly of tub 14, wash basket 70, agitator 18, drive system 24 and motor 20 is mounted on a suspension system 22. A plurality of controls 26 are provided on a control console 28 for automatically operating the washer through a series of washing, rinsing and liquid extracting steps as is well known in the art.

Figure 2:
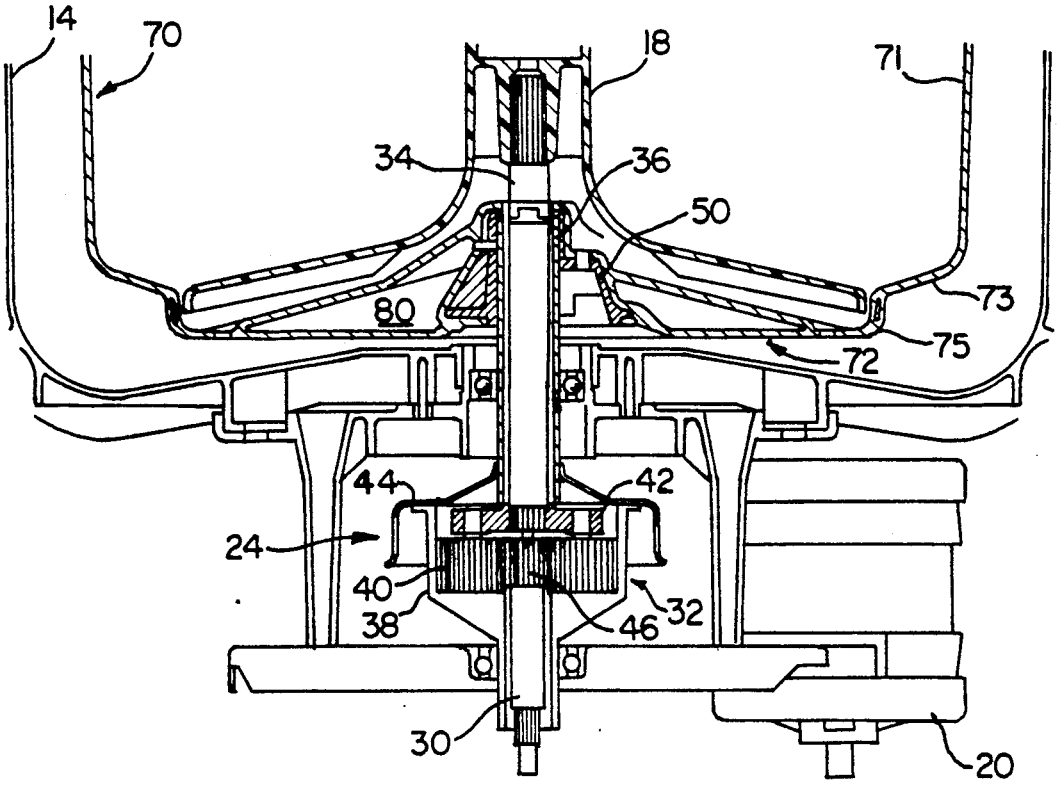
FIG. 2 is a partial sectional view of the agitator and wash basket and drive system of the washer of FIG. 1.

Portions of the drive system 24 and the plastic wash basket 70 of the present invention are shown in greater detail in FIG. 2 where it is seen that the motor 20 is operably connected to a drive shaft 30 which, through a gear arrangement such as a planetary gear assembly 32, drives a vertical shaft 34 drivingly connected to the vertical axis agitator 18. The plastic wash basket 70 is connected via a spin tube 36 to an agitator ring gear 38 of the planetary gear arrangement 32 having an external generally cylindrical hub surface 44. The vertical shaft 34 is connected to a planet gear 40 through the use of a connecting carrier plate 42. A sun gear 46 is directly connected to the drive shaft 30. The drive system described above and illustrated in the appended drawings is an exemplary embodiment of a known drive system as can be found in U.S. Pat. No. 4,890,465.

The plastic wash basket 70 is shown having a generally cylindrical outer wall 71 defining a vertical axis. The generally cylindrical outer wall 71 has an upper end open for receiving clothes and a lower end 73. A base 72, formed integrally with the cylindrical outer wall 71, is provided for forming a bottom of the wash basket 70 and has an outer edge 75 interconnected With the lower end 73 of the generally cylindrical outer wall 71. A hub member 50 is centrally positioned within the base 72 of the plastic wash basket 70. An annular cavity 80, having a generally triangular radial cross-section, is formed within the base 72 and surrounds the hub member 50 such that the base 72 comprises walls, described hereinbelow, configured to define the annular cavity 80.

Figure 4:
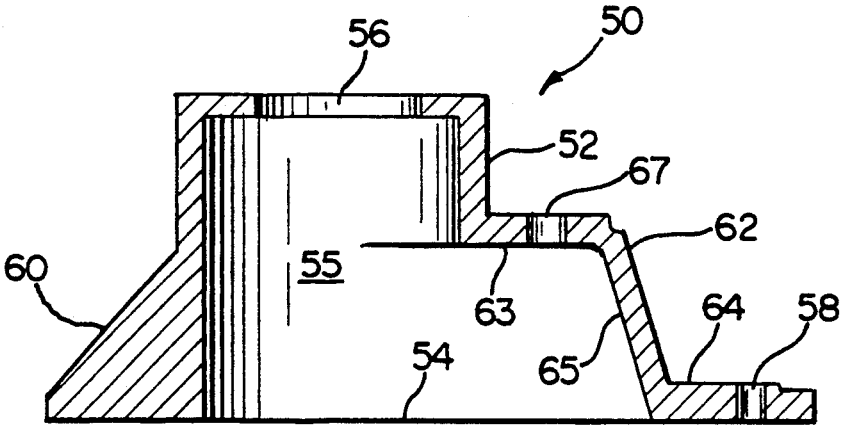
FIG. 4 is a sectional view of the hub member taken along lines 4—4 of FIG. 3.
Figure 3:
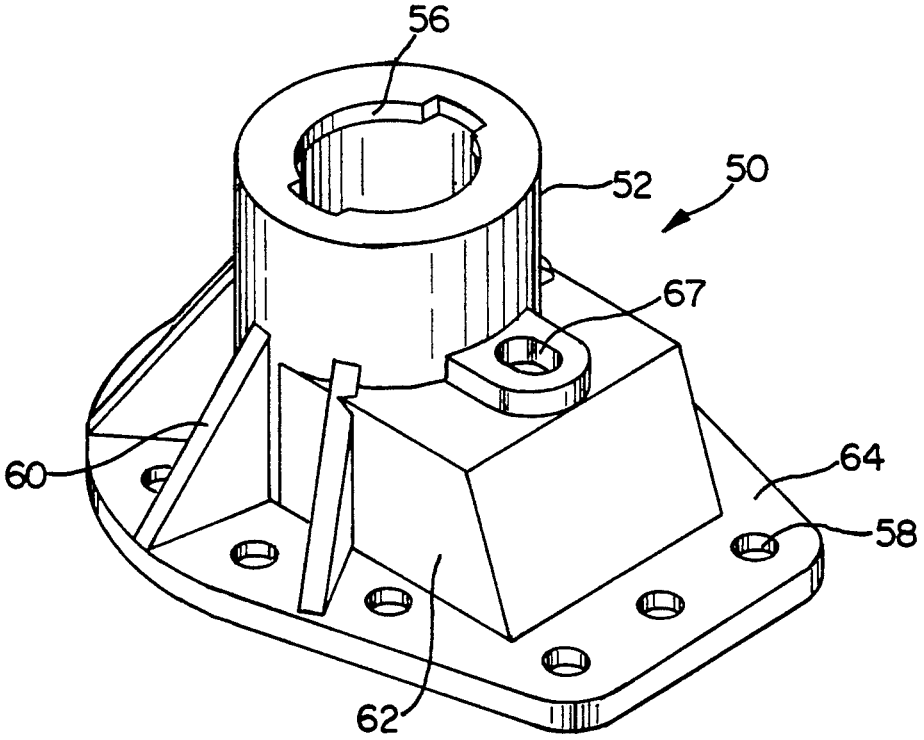
FIG. 3 is a perspective view of the hub member of the present invention.

The hub member 50 is shown in greater detail in FIG. 3 and FIG. 4. The hub member 50 includes a generally cylindrical hollow portion 52 defining a vertical axis and having an upper end and a lower end. A substantially rectangular hollow portion 62 intersects the lower end of the cylindrical hollow portion 52. A flange portion 64, perpendicular to the vertical axis defined by the cylindrical hollow portion 52, intersects the lower end of the cylindrical hollow portion 52 and the open bottom of the rectangular hollow portion 62. The cylindrical hollow portion 52 and the rectangular hollow portion 62 define an interior cavity 55 having an open bottom end 54 and an open top end 56. The lower portion of the interior cavity 55 has a cross-section, perpendicular to the vertical axis defined by the cylindrical hollow portion 52, having a shape of a rectangle having a semicircular, rounded end. The upper portion of the interior cavity has a substantially circular cross-section perpendicular to the vertical axis of the cylindrical hollow portion 52.

The interior cavity 55 of the hub member is substantially identical and performs a utility substantially similar to known apparatus for cooperating with a spin tube for rotating a metallic basket and is therefore only briefly described below. The open bottom end 54 of the cavity 55 allows insertion of the spin tube 36 such that the spin tube 36 is driveably connectible with the hub member 50. Additionally, the open bottom end 54 of the cavity 55 allows insertion of a pillow block (not shown) which may be drawn up toward a top surface 63 of the rectangular hollow portion 62 by a bolt (not shown) which extends through a hole 67 into a threaded hole of the pillow block. The pillow block may therefore be wedged between the inner surface of an angular wall 65 of the rectangular hollow portion 62 and the spin tube 36 such that the wash basket 70 is securely connected to the spin tube 36 and vertical motion of the wash basket 70 is prevented. The open upper end 56 of the cavity 55 allows the vertical shaft 34 to extend through the hub member 50 for driveable inter-connection with the agitator 18. The hub member 50, therefore, supports and drivingly rotates said plastic wash basket 70.

In addition to having means for rigidly connecting with the spin tube 36, the hub member's configuration also provides means for mechanically interlocking the hub member 50 with the plastic wash basket 70. In the preferred embodiment contemplated by the inventor, the plastic wash basket 70 is molded around the hub member 50. Therefore, the hub member 50 becomes mechanically locked with the base 72 of the wash basket 70. Various external features of the hub member 50 further enhance this mechanical interlocking with the base 72 of the wash basket 70 such that the hub member may drivingly rotate and vertically support the wash basket 70. A first means for mechanical interlocking with the hub member 50 with the base 72 for drivingly rotating the wash basket 70 is provided by a plurality of external axial ribs 60, extending from the cylindrical portion 52 of the hub member 50. A second means for mechanical interlocking with the base 72 for drivingly rotating the wash basket 70 is provided by a plurality of holes 58, coaxial with the generally cylindrical portion 52 are located on the flange portion 64. The flange portion 64 provides the primary means for interlocking with the base 72 for vertically supporting the wash basket 70. Rigid mechanical interlocking between the hub member 50 and the base 72 is further enhanced by the inherent tendency of plastic to shrink during molding such that the base 72 shrinks around the hub member 50 during the molding.

A top elevational view of the base 72 of the wash basket 70 is shown in FIG. 5. As stated above, the hub 50 is disposed within the center of the base 72, coaxial with the vertical axis defined by the cylindrical outer-wall 71. The base includes an inner portion having alternating first upper wall sections 74 and second upper wall sections 76 extending from the hub member 50. This configuration of alternating first upper wall sections 74 and second upper wall sections 76 illustrates the preferred embodiment due to existing agitator configurations in commercial applications. With this upper wall configuration, wash basket interference with the agitator 18 is avoided and the first upper wall sections 74 extend from the upper end of the hub member 50 such that an optimum interconnection between the base 72 and the hub 50 is achieved Additionally, the second upper wall sections 76 extend from a middle section of the hub member such that the cavity 80 may have angularly alternating portions having a pure triangular radial cross section. It is contemplated by the inventor that with a redesigned agitator, an annular cavity having an angularly continuous pure triangular radial cross section may be utilized having a continuous upper wall extending from the upper end of the hub member 50.

The annular cavity 80 is defined by a first wall 82, a second wall 84 and a third wall 86 as shown in FIG. 6. The first wall 82 is disposed adjacent and mechanically interlocks with the hub member 50. At angular positions corresponding to the second upper wall sections 76, the first wall 82 has an upper end 81 and a lower end 83. At angular positions corresponding to the first upper wall sections 74, the first wall 82 has an upper end 81' and a lower end 83'. A second wall 84 extends from the lower end 83 83' of the first wall 82 toward the outer edge 75 of the base 72 and is substantially perpendicular to the vertical axis defined by the generally cylindrical outer wall 71. The third wall 86 includes at alternating angular positions the first upper wall section 74 and the second upper wall section 76 and interconnects with the second wall 84 near the outer edge 75 of the base 72 and extends upwardly and inwardly to the upper end 81 8' of the first wall 82. At angular positions having the second upper wall sections 76 extending from the hub member 50, the first wall 82, second wall 84 and third wall 86 interconnect such that a triangular truss shape is formed to give the wash basket 70 stiffness and strength. The triangular truss shape is such that a vertical downward force applied to the outer edge 75 of the base 72 places the second wall 84 in compression and the third wall 86 in tension.

A plurality of radially extending ribs 90 may be included in the forming of the cavity 80. As shown in FIG. 7, the plurality of radial extending ribs may be angularly spaced within the cavity 80 of the base and interconnect with the walls 82 84 86 of the cavity 80. These radially extending ribs 90 may provide further stiffness and strength to the base 72 by preventing the walls 82 84 86 of the base 72 from buckling under load.

The molding of the plastic wash basket 70 to incorporate the hub member 50 and provide the annular cavity 80 surrounding the wash basket may require special processing which is not generally known to general plastic processors but is well known by processors having special skills in the art of producing cavities in injection molded parts. Several molding processes are available which allow the creation of large hollow sections in injection molding. One proprietary molding process available from Detroit Plastic Molders which may be utilized is Gas Assisted Injection, known as GAIN in the art. Another proprietary molding process, known as Nitrojection, available from Sajar Plastics Inc. may also be utilized. Additionally, Hettinga Equipment Inc. has molding equipment and techniques which can provide the required hollow section molding.

The above described wash basket configuration 70, therefore, provides a novel base structure 72 which gives the wash basket 70 required stiffness and strength While providing stiffness and strength, the wash basket configuration does not cause the formation of an undue amount of suds between the wash basket 70 and tub 14. Additionally, no metallic reinforcing plate is required to provide strength to the base 72. Furthermore, the above described novel wash basket 70 has a base 72 having a relatively high degree of stiffness and strength as compared to known commercial plastic wash baskets and therefore may utilize a relatively thin outer cylindrical wall 71 such that less material is required for producing the wash basket 70.

Although the present invention has been described with reference to a specific embodiment, those of skill in the Art will recognize that changes may be made thereto without departing from the scope and spirit of the invention as set forth in the appended claims.

We claim:

1. A rotable wash basket disposed within a imperforate tub for use with a vertical axis automatic washer, said wash basket comprising:

an integral plastic body, said plastic body further including:

a general cylindrical outerwall defining a vertical axis and further having an upper end open for receiving clothes for wash treatment and a lower end, a base for forming a bottom of said generally cylindrical outerwall, said base having an outer edge integral with said lower end of said cylindrical member;

an annular cavity formed within said base; and a hub member positioned centrally within and integrally molded with said base and having means drivingly connectable with a drive shaft for rotating said wash basket and further having said annular cavity disposed around said hub member, said hub member further comprising:

a generally cylindrical hollow portion having an axis aligned with said vertical axis, and having an upper and a lower end, said generally cylindrical hollow portion further having a first means for mechanically interlocking with said base;

a substantially rectangular hollow portion intersecting said generally cylindrical hollow portion and having an open bottom corresponding to said lower end of said generally cylindrical hollow portion such that said generally cylindrical hollow portion and said substantially rectangular hollow portion define an interior cavity of said hub member having an open top end and open bottom end and further having a lower portion having a substantially rectangular cross-section and an upper portion having a substantially circular cross-section; and a flange portion intersecting said lower end of said generally cylindrical hollow portion and said open bottom of said substantially rectangular hollow portion and further having a second means for mechanically interlocking with said base.

2. A rotatable wash basket according to claim 1, wherein said hub member is metallic.

3. A rotatable wash basket according to claim 1, wherein said first means for mechanically interlocking with said base comprises a plurality of external axial ribs located on said lower end of said generally cylindrical hollow portion.

4. A rotatable wash basket according to claim 1, wherein said second means for mechanically interlocking with said base comprises a plurality of holes substantially coaxial with said vertical axis and located on said flange portion.

5. A rotatable wash basket according to claim 1, wherein said annular cavity formed within said base has a substantially triangular radial cross-section such that said base is configured for providing rigidity and stiffness to said wash basket.

6. A rotatable wash basket as claimed in claim 5, wherein said base having said annular cavity having said substantially triangular radial cr, further comprises:

a first wall formed along said hub having an upper end and a lower end;

a second wall substantially perpendicular to said vertical axis and extending outwardly from said lower end of said first wall toward said outer edge of said base; and a third wall interconnected with said second wall near said outer edge of said base and extending at an acute angle upwardly and inwardly to said upper end of said first wall, and said first, second and third walls being interconnected such that a vertical downward force applied to said outer edge of said base places said second wall in compression and said third wall in tension for eliminating bending and increasing base rigidity.

7. A rotatable wash basket according to claim 6, wherein said first wall, said second wall and said third wall have substantially equal wall thickness.

8. A rotatable wash basket according to claim 1, wherein said outerwall has a thickness of approximately 5 mm or less.

9. A rotatable wash basket disposed within an imperforate tub for use with a vertical axis automatic washer, said wash basket an integral plastic body, said plastic body further including:

a generally cylindrical outerwall defining a vertical axis and further having an upper end open for receiving clothes for wash treatment and a lower end, a base for forming a bottom of said cylindrical member, said base having an outer edge integral with said lower end of said generally cylindrical outerwall, said base further having an annular cavity formed within said base, said annular cavity having a triangular radial cross section, said base further comprising:

a first wall parallel with said vertical axis and further having an upper end and a lower end, a second wall substantially perpendicular to said vertical axis and extending outwardly from said lower end of said first wall toward said outer edge of said base, and a third wall interconnected with said second wall near said outer edge of said base and extending at an acute angle upwardly and inwardly to said upper end of said first wall, and said first, second and third walls having substantially equal wall thicknesses and being interconnected such that a vertical downward force applied to said outer edge of said base places said second wall in compression and said third wall in tension for eliminating bending and increasing base rigidity;

a metallic hub member positioned centrally within and integrally molded with said first wall of said annular cavity and having means drivingly connectable with said drive shaft for rotating said wash basket and further having said annular cavity disposed around said hub member, said hub member further including:

a generally cylindrical hollow portion having an axis aligned with said vertical axis of said body, and having an upper and a lower end, said generally cylindrical hollow portion further having a plurality of external axial ribs extending from said lower end of said generally cylindrical hollow portion for mechanically interlocking with said base, a substantially rectangular hollow portion intersecting said generally cylindrical hollow portion and having an open bottom corresponding to said lower end of said generally cylindrical hollow portion such that said generally cylindrical hollow portion and said substantially rectangular hollow portion define an interior cavity of said hub member having an open top end and open bottom end and further having a lower portion having a substantially rectangular cross-section and an upper portion having a substantially circular cross-section, and a flange portion intersecting said lower end of said generally cylindrical hollow portion and said open bottom of said substantially rectangular hollow portion and further having a plurality of holes substantially coaxial with said vertical axis for mechanically interlocking with said base.

10. A rotatable wash basket according to claim 9, wherein said generally cylindrical outerwall has a thickness of 5 mm or less.

11. An automatic washer comprising:

an imperforate tub;

a motor having an output shaft;

a drive system connectable with said output shaft and having a drive shaft; and a rotatable wash basket disposed within said imperforate tub, said wash basket further including:

an integral plastic body, said plastic body further including:

a generally cylindrical outerwall defining a vertical axis and further having an upper end open for receiving clothes for wash treatment and a lower end, a base for forming a bottom of said cylindrical member, said base having an outer edge integral with said lower end of said generally cylindrical outerwall, said base further having an annular cavity formed within said base, said annular cavity having a triangular radial cross section, said base further comprising:

a first wall parallel with said vertical axis and further having an upper end and a lower end, a second wall substantially perpendicular to said vertical axis and extending outwardly from said lower end of said first wall toward said outer edge of said base, and a third wall interconnected with said second wall near said outer edge of said base and extending at an acute angle upwardly and inwardly to said upper end of said first wall, and said first, second and third walls being interconnected such that a vertical downward force applied to said outer edge of said base places said second wall in compression and said third wall in tension for eliminating bending and increasing base rigidity; a hub member positioned centrally within and integrally molded with said first wall of said annular cavity and having means drivingly connectable with said drive shaft for rotating said wash basket and further having said annular cavity disposed around said hub member, said hub member further including:

a generally cylindrical hollow portion having an axis aligned with said vertical axis of said body, and having an upper and a lower end, said generally cylindrical hollow portion further having a first means for mechanically interlocking with said base, a substantially rectangular hollow portion intersecting said generally cylindrical hollow portion and having an open bottom corresponding to said lower end of said generally cylindrical hollow portion such that said generally cylindrical hollow portion and said substantially rectangular hollow portion define an interior cavity of said hub member having an open top end and open bottom end and further having a lower portion having a substantially rectangular cross-section and an upper portion having a substantially circular cross-section, and a flange portion intersecting said lower end of said generally cylindrical hollow portion and said open bottom of said substantially rectangular hollow portion and further having a second means for mechanically interlocking with said base.

12. A rotatable wash basket according to claim 11, wherein said hub member is metallic.

13. A rotatable wash basket according to claim 11, wherein said first means for mechanically interlocking with said base comprises a plurality of external axial ribs located on said lower end of said generally cylindrical hollow portion.

14. A rotatable wash basket according to claim 11, wherein said second means for mechanically interlocking with said base comprises a plurality of holes substantially coaxial with said vertical axis and located on said flange portion.

15. A rotatable wash basket according to claim 11, wherein said first wall, said second wall and said third wall have substantially equal wall thickness.

16. A rotatable wash basket according to claim 11, wherein said generally cylindrical outerwall has a thickness of approximately 4 mm or less.

* * * * *